United States Patent [19]

Pacansky

[11] 4,096,294

[45] Jun. 20, 1978

[54] PROCESS FOR PREPARING WATERLESS PRINTING MASTERS COMPRISING COPOLYMER OF SILOXANE AND CRYSTALLIZED THERMOPLASTIC BLOCKS

[75] Inventor: Thomas J. Pacansky, Penfield, N.Y.

[73] Assignee: Xerox Corporation, Stamford, Conn.

[21] Appl. No.: 784,183

[22] Filed: Apr. 4, 1977

[51] Int. Cl.[2] ..... B05D 5/04; B05D 1/06

[52] U.S. Cl. ..... 427/197; 96/33; 101/465; 101/467; 427/14; 427/374 A; 427/374 B; 427/374 C; 427/375; 427/379; 427/387; 427/388 A; 427/388 R

[58] Field of Search ..... 101/457, 462, 465, 466, 101/467; 427/197, 14, 374 C, 387; 96/33, 1.4

[56] References Cited

U.S. PATENT DOCUMENTS

| | | | |
|---|---|---|---|
| 3,260,612 | 7/1966 | Dulmage et al. | 427/53 X |
| 3,967,962 | 7/1976 | O'Malley | 427/22 X |
| 4,009,032 | 2/1977 | Schank | 101/466 X |

FOREIGN PATENT DOCUMENTS

| | | | |
|---|---|---|---|
| 755,567 | 3/1967 | Canada | 427/197 |

*Primary Examiner*—Ronald H. Smith
*Assistant Examiner*—Evan K. Lawrence

[57] ABSTRACT

A process for preparing a waterless printing master having a minimum background ink reflection density comprises coating a master substrate with an ink releasing block copolymer comprising elastomeric ink releasing siloxane blocks and isothermally crystallizable thermoplastic organic blocks. Thereafter, the thermoplastic blocks are isothermally crystallized and the siloxane blocks are preferably cross-linked. The printing master is imaged by depositing ink accepting particulate imaging material on the copolymer coating and heating and cooling the thermoplastic blocks to bond the particulate imaging material thereto.

20 Claims, No Drawings

PROCESS FOR PREPARING WATERLESS PRINTING MASTERS COMPRISING COPOLYMER OF SILOXANE AND CRYSTALLIZED THERMOPLASTIC BLOCKS

BACKGROUND OF THE INVENTION

This invention relates to a novel waterless lithographic master of the planographic type and to a method for preparing said master.

In conventional lithography, an aqueous fountain solution is employed to prevent the ink from wetting the nonimaged areas of the planographic plate. It has recently been discovered that the requirement for a fountain solution can be obviated by employing a planographic plate having a silicone, i.e. organopolysiloxane, elastomeric layer. Because the silicone is not wetted by the printing ink, no fountain solution is required. While the use of silicone elastomers as a printing surface has obviated the requirement for a fountain solution, it has been found that finely divided particulate material commonly referred to in the trade as "toner", is not easily attached to the silicone. Thus, the abhesive or nonadhesive property of the silicone which renders it useful for rejecting lithographic inks, also causes it to reject other materials such as toner. Accordingly, it has been difficult to prepare a printing master in which the toner could be sufficiently attached to the silicone such that it would not become removed after a short run on a printing press.

In order to adhere a particulate imaging material to the abhesive silicone, it has been discovered that a copolymer can be employed comprising a major portion of siloxane blocks and a minor portion of organic thermoplastic blocks. This permits the master to be imaged with a particulate image material and the thermoplastic blocks softened and then hardened to bond the particulate imaging material thereto. Thus, the thermoplastic blocks permit the imaging material to be physically bonded thereto and the siloxane blocks provide an insoluble ink releasing background area so that no dampening or fountain solution is required. A difficulty encountered with the block copolymers, however, is that the background areas tend to ink slightly so as to impair the contrast. It is this problem to which this invention is directed.

SUMMARY OF THE INVENTION

It has now been discovered that a master comprising a conventional self-supporting master substrate and an overlying layer of a block copolymer having ink releasing elastomeric siloxane blocks, which are preferably crosslinked, and image accepting organic isothermally crystallized thermoplastic blocks, can be formed to provide substantially no background inking. The printing master is imaged by depositing particulate imaging material on the copolymer coating and heating and cooling the thermoplastic blocks to bond the particulate imaging material thereto. Surprisingly, it has been discovered that these copolymers provide printing masters with a three-fold decrease in background ink reflection density.

DESCRIPTION OF THE PREFERRED EMBODIMENTS

Typical materials which include the types of master materials as well as instructions for preparing the masters are herein discussed in detail.

Substrates which can be employed for the printing master are those self-supporting materials to which the copolymer can adhere and be compatible therewith as well as possess sufficient heat and mechanical stability to permit use under widely varying conditions. Exemplary of suitable substrates are paper; metals such as aluminum; plastics such as polyesters, polycarbonates, polysulfones, nylons and polyurethanes.

When a substrate which is nonphotoconductive is employed, the substrate can be coated with a photoconductive material by conventional means such as draw bar coating, vacuum evaporation and the like. A thickness of between 0.02 and 20 microns is conventional. Typical inorganic crystalline photoconductors include cadmium sulfide, cadmium sulfoselenide, cadmium selenide, zinc sulfide, zinc oxide and mixtures thereof. Typical inorganic photoconductive materials include amorphous selenium, and selenium alloys such as selenium-tellurium, and selenium-arsenic. Selenium may also be used in its hexagonal crystalline form, commonly referred to as trigonal selenium. Typical organic photoconductors include phthalocyanine pigments such as the X-form of metal free phthalocyanine described in U.S. Pat. No. 3,357,989 to Byrne et al, and metal phthalocyanine pigments, such as copper phthalocyanine. Other typical organic photoconductors include poly(vinyl carbazole), trinitrofluorenone and photo-injecting pigments such as benzimidazole pigments, parylene pigments, quinacridone pigments, indigoid pigments and polynuclear quinones. Alternatively, the photoconductor can be dispersed in a binder of one of the aforesaid polymeric substrate materials to serve as the ink accepting substrate.

The surface block copolymers can be characterized as materials represented by any of the following generic schemes: $[BA]_n$, $[AB]_n$, $[ABA]_n$, or $[BAB]_n$, wherein $n$ is a whole number equal to or greater than 1, A represents the amorphous polymeric segment and B represents crystalline or crystallizable polymeric segment. Each segment need not necessarily be homopolymeric. The individual block segments A and B may be linked directly to one another in head to tail fashion such as by covalent bonding resulting from sequential block copolymerization of the appropriate monomers or by coupling reaction between terminal functional groups present on different polymeric molecules. Alternatively, the block segments may be linked by means of difunctional coupling agents which remain in the block copolymer molecules, such as, for example, urethane linkages which would be formed by the reaction of hydroxyl terminated polymers with an organic diisocyanate, or ester linkages formed by the reaction of hydroxy terminated polymers with dicarboxylic acids or carboxy terminated polymers with glycols, or other linkages formed by reaction of hydroxy terminated polymers with phosgene, dichlorodimethyl silane, dimethylamino silane and the like.

Where the block copolymers are formed using difunctional coupling agents, the above recited formula schemes for such block copolymers should be considered generic to a specific scheme wherein the coupling agent moiety is present in the block copolymer molecule connecting the A segment to the B segment. In turn, each A or B segment depicted generically above may comprise a plurality of individual A segments coupled together or a plurality of B segments coupled together. Thus, for example, the formula $[BA]_n$ should, for the purposes of the present invention, be considered generic to [B']-C-[A'] wherein each B' and A' segment may consist of a single polymeric molecule or a plurality of polymeric molecules of similar structure coupled together, such as where [B'] is B or [(B-C-(mB)] and [A'] is A or [A(-C-A)m], further wherein A and B are as specified above, *m* is a positive whole integer equal to 1 or greater, and C is the coupling agent moiety. The same holds true for the three other generic formula schemes recited above. Although the coupling technique is preferred because it offers more precise control over the amounts of each type of polymer introduced into the polymer chain, it is to be emphasized that any polymerization technique known to those skilled in the art affording the capability of preparing the tailor-made block copolymers of the present invention may be used.

The surface block copolymer layer material is formed of ink releasable, elastomeric polysiloxane blocks and organic isothermal crystalline, thermoplastic blocks which provide physical strength and can be alternately softened (melted) and hardened (crystallized) so as to bond the particulate imaging material thereto. An amount of heat energy is required to transform the block copolymer crystalline segments from a crystalline state to the state where the block copolymer will flow and adhere with the toner. This heat energy requirement is known as the "Heat of Fusion" and may be defined as the amount of energy necessary in transforming a polymer from a crystalline or a partially crystalline state to a completely disordered amorphous state without a change in temperature in the crystalline segments of the polymer. The heat of fusion ($\Delta H_f$) is directly relatable to the degree of crystallinity of a given polymer: the higher the crystallinity, the greater the heat of fusion, and the greater the amount of heat necessary to melt the polymer. The degree of crystallinity can be modified by thermally, chemically, mechanically or solvent treating the crystalline material. The particular method and conditions depend on the properties of the crystalline material and the application.

The siloxane blocks can be those having only alkyl containing groups in the polymer chain such as polydimethylsiloxane or polydiethylsiloxane; gums having both alkyl and phenyl containing groups in the polymer chain as well as gums having both alkyl and vinyl groups, alkyl and fluorine groups or alkyl, phenyl and vinyl groups in the polymer chain.

Other silicones can be employed as the hard segment including crystalline or glassy polymeric silanes and siloxanes such as poly(m-xylylenetetraalkyldisiloxanylene), poly(p-xylylenetetraalkyldisiloxanylene), poly(1,3-bis(p-dialkylsilphenylene)hexafluoropropylene oxide), poly(1,6-bis(p-dialkylsilphenylene)dodecafluoropropylene oxide), and poly(p-tetraalkylsilphenylene siloxane) wherein the alkyl groups are linear, branched or cyclic and can have from 1 to 12 carbons with from 0 fluorine atoms to fully fluorinated. These crystalline or glassy silicones can also be used as toners or imaging materials.

The organic, crystalline materials employed to form the hydrocarbon backbone thermoplastic blocks in the copolymer are conventional thermoplastic monomers such as styrene, α-methylstyrene, styrene/n-butyl methacrylate, and styrene-butadiene. The thermoplastic blocks may also contain condensation polymers such as polyester, polyvinyl ester, polyether, polyamide, polyacid, polyurethane, or polycarbonate materials. Examples of these are epichlorohydrinbisphenol-A polymers, poly(hexamethylene sebacate), Nylon 66, poly(decamethylene sebacate), poly(decamethylene succinate), poly(ethylene sebacate), poly(ethylene succinate), poly(hexamethylene sebacate), poly(hexamethylene suberate), poly(hexamethylene succinate), poly(p-xylylene adipate) or poly(diethylene glycol terephthalate), poly(vinyl ethyl ether), poly(vinyl butyl ether), poly(vinyl 2-methoxyethyl ether), poly(vinyl stearate), poly(decamethylene sulfide), poly(hexamethylene sulfide), poly(tetramethylene sulfone), poly(butadiene oxide), poly(ethylene oxide), poly(propylene oxide), poly(epifluorohydrin), poly(cis-1,4-butadiene) and poly(trans-1,2-butadiene), poly(1-pentene), poly(1-hexadecene), polybutene, poly(3-methyl-1-butene), cellulose tricaprate, and poly(isobutyl acrylate). Copolymers derived from monomers constituting two or more of the above polymers may also be used. Particularly preferred as crystalline segments in the block or graft copolymers are these polymers and copolymers having a crystalline polymer or copolymer melting point (Tm) within the range of about 40° C to about 230° C.

While not limiting, preferred proportions for the copolymer comprise a ratio by weight of between about 50–99 parts polysiloxane to 1 to 50 parts of the thermoplastic blocks. A most preferred ratio is from about 80–90 parts polysiloxane groups to provide optimum ink releasing properties and image adhesion properties.

Catalysts which will preferentially cure the siloxane blocks may also be employed to improve the physical strength of the coatings. Typical catalysts include the peroxides such as benzoyl peroxide, silanes and the like, the particular catalyst depending upon the silicone employed. Suitable catalysts are provided by the manufacturers of the silicone gums.

Copolymers of the above type can be prepared in the manner illustrated by the procedure for preparation of a poly(dimethylsiloxane)/poly(hexamethylene sebacate) (PDMS)/(PHMS) block copolymer as described in Examples I – X. Suitable degree of crystallinity to provide low background ink reflection density will vary depending upon the particular blocks employed in the copolymer. Generally, the crystalline blocks (hard segment) will have a degree of crystallinity of from 10% to 95% and preferably in the range of 60–95% and will have a number average molecular weight sufficient to crystallize in the block copolymer matrix and provide physical strength; that is, in the range of 1,000 to 20,000 and preferentially 2,000–14,000. The block copolymer molecular weight should be sufficient to provide film-forming properties.

The degree or percent of crystallinity can be measured under a nitrogen atmosphere employing a Perkin Elmer DSC-11 differential scanning calorimeter using a temperature scan ratio of 5° K per minute in the range of 280°–400° K according to the general method of Watson, O'Neill et al, Analytical Chemistry, Vol. 36, pg. 1233, 1964, and L. Mandoldelkern et al, Journal of Polymer Science, Vol. B3, pg. 803, 1965. Two heat-cool cycles are run on each sample and isothermal crystallization is accomplished by heating samples to 373° K in a vacuum for one-half hour, slow cooling to 320° K and maintaining for 24 hours. The areas under the melting endotherms are correlated to degree of crystallinity using a value of 32 cal/gm for the heat of fusion for 100% crystalline HMS.

The copolymer can be coated on the substrate by conventional means such as draw bar coating, preferably with a catalyst in a suitable solvent and the solvent allowed to evaporate. The thermoplastic blocks of the copolymer are then isothermally crystallized such as by heating the resultant plate at a temperature sufficient to melt said blocks followed by further heating at about 5°-15° C below the melting point of the thermoplastic blocks for a time sufficient to crystallize the thermoplastic blocks, generally from 1 to 24 hours depending upon the materials and temperature employed. To improve the physical strength properties and decrease abrasion and wear, the siloxane blocks are crosslinked, such as by heat, to activate the catalyst either before and/or after crystallization. For example, the siloxane blocks may be slightly cross-linked prior to crystallization and further cross-linked after crystallization. The amount of cross-linking will depend upon the materials employed, temperature and time but can be measured by its swelling in a suitable solvent. Generally the polymers will swell between about 20% and 300% in dodecane, tetrahydrofuran, xylene, toluene and other solvents listed in *Polymer Handbook,* J. Brandup and E. H. Immergut, pages IV 185 - IV 234, Interscience Publishing, N.Y. 1966. The siloxane blocks should be cured sufficiently such that the copolymer remains ink releasing but not so much that the thermoplastic blocks become cured so that the particulate imaging material cannot be physically bonded thereto. Crosslinking agents made from silicone materials are preferred.

The master can be imaged by conventional means such as electrostatographic imaging, either directly on the master and developed thereon, or formed and developed on a separate photoconductive surface and transferred to the master surface. The particulate imaging material can be any conventional ink accepting material commonly referred to in the art as toner. Preferably, the toner is applied after crystallization of the thermoplastic blocks and before crosslinking of the siloxane blocks. Typical toners include thermoplastic polymers such as polyethylene, polyesters and polymers of styrene. Typical polymers of styrene include polystyrene, styrene/n-butyl methacrylate copolymer and styrene-butadiene copolymer. Other materials which can be employed include: polypropylene, poly(α-methylstyrene), poly(-hexamethylene sebacate), ethylene-vinyl acetate copolymers, polyamides, polyimides, phenoxies, polyesters and vinyls. Although it is preferred, the imaging material need not be thermoplastic. Typical nonthermoplastic materials which can also be employed are carbon black, and inorganic salts. After the master is imaged, the particulate material can be fixed by heating the master to soften the thermoplastic blocks and then cooling or allowing the blocks to cool so as to harden and bond the particulate imaging material thereto. Alternatively the copolymer can be removed in image configuration to permit printing from the underlying ink accepting substrate.

The imaged printing master can then be employed on conventional planographic printing equipment by direct or offset means with the dampening system removed to provide good quality prints over an extended period of operation with conventional inks of the oleophilic, glycol or rubber based type.

The following examples will serve to illustrate the invention and embodiments thereof. All parts and percentages in said examples and elsewhere in the specification and claims are by weight unless otherwise specified.

EXAMPLE I

Crystalline poly(hexamethylene sebacate) (PHMS) was prepared according to U.S. Pat. No. 3,967,962 using a bottle equipped with a stirrer, nitrogen gas inlet tube, thermometer, and condenser by reacting 1.0 mole sebacic acid with 1.1 mole of 1,6-hexamethylene glycol in the presence of 0.5% (wt) p-toluenesulfonic acid. The 10% mole excess of glycol was used to ensure the predominant presence of hydroxyl end groups in the reaction product. The mixture was heated to 165° C while stirring. An amount of xylene was added to assist refluxing and this temperature was maintained until water evolution ceased (about 4 hours). The condensers were then removed and the excess glycol and catalyst were removed by purging with $N_2$ for 0.5 hr at 165° C. On cooling to room temperature, the PHMS crystallized into an off-white solid. The PHMS was reprecipitated from benzene solution into methanol, collected by filtration, dried in vacuo to afford a 71% yield of purified material. This material had an acid number of 0.79, intrinsic viscosity in chloroform at 25° C of 0.17, $\overline{M}_n$ of 2660, a MWD ($\overline{M}_w/\overline{M}_n$) of 1.98 by gel permeation chromotography (GPC) in chloroform at 25° C, a glass transition temperature of about −55° C to −62° C and a crystalline melting point of about 57°-65° C.

EXAMPLE II

According to the method of Example I another PHMS sample was prepared with the exception that 20 mole % excess 1,6-hexamethylene glycol was used. Purified material was obtained in 74% yield and had an acid number of 2.03, intrinsic viscosity in chloroform at 25° C of 0.16, $\overline{M}_n$ of 2480, a glass transition temperature of about −55° C to about −62° C and a crystalline melting point of about 57°-65° C.

EXAMPLE III 1,7-dichlorooctamethyltetrasiloxane was prepared according to the method of Bennett, U.S. Pat. No. 3,646,090. A dry 1 liter 3-necked flask equipped with a heating mantle, magnetic stirrer, condenser, thermometer and a gas inlet tube, was charged with 148.3g (0.5 mole) of octamethylcyclotetrasiloxane (Petrarch Systems, Levittown, Pa.), 416.4g (3.5 mole) of thionyl chloride (J. T. Baker Co.) and 4.8g (0.017 mole) of triphenyl phosphine oxide (Eastman Organic Chemical Co.). The solution was heated to 60° C until $SO_2$ evolution was complete. About 38g (119% of theory) were lost for a reaction time of 20 hours. The excess weight loss was probably due to evaporation or removal by nitrogen purge. The thionyl chloride was removed by distillation. The remaining material (172.1g, 97.9% of theory) was the crude product. This material was quickly filtered with a nitrogen purge through a rigorously dried filter into a dry distillation flask. Two product fractions (155.5g, or 88.5% yield) were collected upon distillation at 22mm Hg. One material (15.2g, b.p. 100° C) was 1,5-dichlorohexamethyltrisiloxane. This corresponded to the amount of hexamethylcyclotrisiloxane contained in the octamethylcyclotetrasiloxane. The other material (1.40.3g, b.p. 105°-110° C) was 1,7-dichlorooctamethyltetrasiloxane.

Anal. THEORY: C: 27.4; H: 6.8; Si: 31.9; Cl: 20.2. FOUND: C: 27.48; H: 6.75; Si: 32.20; Cl: 19.92.

EXAMPLE IV 1,7-bis(dimethylamino)-octamethyltetrasiloxane was prepared according to the method of Creamer, U.S. Pat. No. 3,467,686 with the exceptions of isolation methods. A dry 3-necked 500ml round bottom flask equipped with a mechanical stirrer, heating mantle, gas inlet tube to below the liquid surface and a condenser having a drying tube at the outlet was charged with 134.8g (0.38 mole) of 1,7-dichlorooctamethyltetrasiloxane and 26.4g (1.09 mole) of magnesium. After flushing with nitrogen and while maintaining a dry nitrogen purge the mixture was heated with stirring to 110°–130° C. Dimethyl amine was then added slowly for 24 hours. Another 14.0g of magnesium was added after 18 hours. The reaction was over when the white amine-hydrochloride precipitate no longer formed at the mouth of the gas inlet tube. At this time the reaction flask gained 37.5g (83% of theory). The crude product was isolated by filtration. Additional crude product was isolated by placing the isolated precipitate into a 2 liter distillation flask, adding about 200ml of high boiling silicone oil (D.C. 200 fluid, 50 csk, Dow Corning Corp.) and distilling the remaining crude product from the precipitate. The crude product (123.0g, 86.5% yield) was distilled at 22mm Hg. The product fraction boiling at 126°–128° C was collected to afford 84.2g (59.1% yield) of 1,7-bis(-dimethylamino)-octamethyltetrasiloxane.

Anal. THEORY: C: 39.1; H: 9.8; N: 7.6; Si: 30.4; Cl: 0.0. FOUND: C: 38.90; H: 9.65; N: 7.40; Si: 30.60; Cl: 0.10.

EXAMPLE V

Poly(dimethylsiloxane) (PDMS) was prepared as follows. A dry 3-necked 250ml round bottom flask, equipped with an oil bath, mechanical stirrer, reflux condenser and a gas inlet tube, was charged with 79.8g of octamethylcyclotetrasiloxane. After heating to 120° C with thorough nitrogen purging, the temperature was stabilized at 90°–95° C and 7.95g of 1,7-bis(dimethylamino)octamethyltetrasiloxane was added. After 15 minutes of purging, 0.98g of tetramethyl ammonium silanolate was added as the equilibrium polymerization catalyst. Within five minutes the viscosity rose sharply and gradually decreased to an equilibrium value. The temperature was maintained at 90°–95° C for 5 hours to insure equilibration. The temperature was raised to 140° C with vigorous purging, and maintained for 2 hours, to destroy the polymerization catalyst. A small sample was removed for amine end group titration. Using a potentiometric titration technique the nitrogen content was found to be 0.65% which corresponding to a $\overline{M}_n$ of 4310. The theoretical $\overline{M}_n$ was 4100.

EXAMPLE VI

A PDMS/PHMS block copolymer was prepared according to the method of Matzner et al, U.S. Pat. No. 3,701,815. To the solution of Example V was added 58.2g of o-dichlorobenzene and 61.3g of a solution containing 53.1g PHMS, ($\overline{M}_n$ 2480) in 46.9g of freshly distilled o-dichlorobenzene. The mixture was maintained at 160° C with a nitrogen purge for 12 hours. All subsequent additions were made according to the following schedule.

| Time (hr.) | Increment | Amount of Addition |
|---|---|---|
| 0 | 1 | ½ of sample |

-continued

| Time (hr.) | Increment | Amount of Addition |
|---|---|---|
| 12 | 2 | ¼ of sample |
| 15 | 3 | ⅛ of sample |
| 17 | 4 | ⅛ of sample |

After 20 hours the reaction was quenched by precipitating into 2 liters of methanol and stirred overnight. The precipitate was isolated by filtration dissolved in benzene and reprecipitated into 2 liters of methanol. After stirring overnight, the block copolymer was isolated, dried in a vacuum oven at 70° C using water aspirator pressure to yield 115.5g (86.9%). The ash content corresponded to a PDMS content of 59% (wt). Analysis by NMR corresponded to 52% (wt) silicone. The intrinsic viscosity in THF at 25° C was 0.42. $\overline{M}_n$ as determined by membrane osmometry in toluene at 36° C was 20,800. The MWD as determined from GPC in tetrahydrofuran at 25° C was 2.39.

EXAMPLE VII

The procedure of Example V was followed to prepare PDMS with the exception that 3.87g of 1,7-bis(-dimethylamino)octamethyltetrasiloxane was added to the cyclic siloxane. The $\overline{M}_n$ was found to be ~11,200.

EXAMPLE VIII

According to the method in Example VI, a block copolymer was prepared with the exception that a solution containing 27.8g of PHMS ($\overline{M}_n$ 2660) and 71.2g o-dichlorobenzene was added to the solution of Example VII. The purified block copolymer had a 71% (wt) PDMS content, a $\overline{M}_n$ of 25,100, and a MWD of 2.60 from GPC in tetrahydrofuran at 25° C.

EXAMPLE IX

The procedure of Example V was followed to prepare PDMS with the exception that 2.78g of 1,7-bis(-dimethylamino) octamethyltetrasiloxane was added to 200.0g of octamethylcyclotetrasiloxane. The $\overline{M}_n$ was about 27,000.

EXAMPLE X

According to the method of Example VI, a block copolymer was prepared with the exception that a solution containing 20g of PHMS ($\overline{M}_n$ 2660) and 200g of o-dichlorobenzene was added to the solution of Example IX. The purified block copolymer had a 91% (wt) PDMS, $M_n$ of about 44,000 and a MWD of 4.13 from GPC in tetrahydrofuran at 25° C.

EXAMPLE XI

A printing master is prepared by draw bar coating a thin layer (0.0005 wt) of Chemlok 607 adhesive (~10% solids, Hughson Chemical Co.) on a grained aluminum lithographic master (10 × 15 × 0.006 inches) and air drying for 30 minutes at room temperature, overcoating with a solution consisting of 25.0 grams of a 10 weight percent solution of a film forming polymer of 91/9 poly(dimethylsiloxane)/poly(hexamethylene sebacate) (91/9 PDMS/PHMS) multiblock copolymer (PHMS $\overline{M}_n$ 2660) in xylene blended with 0.05 gram of a 50 percent by weight paste of benzoyl peroxide in silicone oil and air drying to a film thickness of about 6–8 microns. The plate is covered to exclude air and then placed on a hot metal shelf for several minutes at 170°–174° C in an oven to initiate the crosslinking reaction of the siloxane. The plate is then heated at 100° C for 30 minutes then at 47° C for 1 hour to isothermally crystallize the thermoplastic blocks (as determined by differential scanning calorimetry) and the plate allowed to cool to room temperature. The plate is imaged employing a Xerox Model D processor, the image developed on a selenium flat plate with a toner comprising thermoplastic PHMS and the developed image is electrostatically transferred to the surface of the cured block copolymer. The toner image is cofused with the heat sensitive organic PHMS blocks by placing the plate on a hot metal shelf at 166° C in an air oven for 1 minute and then allowing the plate to cool to room temperature. The plate is then mounted on a Davidson Dualamatic printing press operating in the direct mode with Ronico XL91779 rubber base ink and no fountain solution. About 1000 prints were generated. Representative prints had a background ink reflection density ($D_{min}$) of 0.01 employing a Welch Densichron-1 Magnephot System, Model 451-4 equipped with a 3832*a* reflection unit. A 3/16 inch aperture setting was employed and the values corrected to eliminate the reflection density of the paper receiver sheet.

EXAMPLE XII

The procedure of Example XI is repeated but for the exception that the thermoplastic blocks were not isothermally crystallized and the background ink reflection density was found to be 0.03 for a three-fold decrease over the copolymer of Example XI.

EXAMPLES XIII - XIV

The procedures of Examples XI and XII are repeated for making block copolymer printing plates but for the exception that the PHMS segment $\overline{M}_n$ is about 6,000 and about 9,000. Similar results are obtained.

EXAMPLES XV - XVI

The procedures of Examples XI - XII are repeated but for the exception that the multiblock copolymer employed is a block copolymer of PDMS and PHMS blocks in a weight ratio of 71:24 with a PHMS number average molecular weight of 2660. Similar results to those of Examples XI and XII are achieved.

EXAMPLE XVII

Block copolymer samples from Examples I, VI and X which represent various levels of PHMS content were evaluated for heat of fusion ($\Delta H_f$) and melting point ($T_m$). The results are shown in Table I.

TABLE I

| | | First Heat Cycle | | Second Heat Cycle | | % |
|---|---|---|---|---|---|---|
| Ex. | PDMS/ PHMS | $\Delta H_f$ (cal/g) | $T_m$ (° C) | $\Delta H_f$ (cal/g) | $T_m$(° C) | Crystallinity[1] |
| X | 91/9 | 0.046 | — | 0.041 | — | 1.4 |
| X | 91/9 (cry)[2] | 1.7 | 53 | 1.5 | 51 | 56.0 |
| VI | 59/41 | — | — | 5.6 | — | 44.0 |
| VI | 59/41 (cry) | 11.0 | 61 | 10.8 | 57 | 86.0 |
| I | PHMS | 27.9 | — | 26.3 | — | 84.0 |
| I | PHMS (cry) | 31.3 | 70 | 27.0 | 65 | 98.0→ 84.0 |

[1]Based on 32 cal/g as the $\Delta H_f$ of 100% crystalline PHMS.
[2]Isothermally crystallized at 47° C.

As can be seen from the data reported in Table I, the degree of crystallinity and melting point drops off as the % PHMS is decreased. The samples which were isothermally crystallized at 47° C had higher % crystallinity (higher $\Delta H_f$) than the corresponding samples not receiving this treatment. These samples also provided lower background inking.

Having described the present invention with reference to these specific embodiments, it is to be understood that numerous variations can be made without departing from the spirit of the invention and it is intended to include such reasonable variations and equivalents within the scope.

What is claimed is:

1. A process of preparing an ink releasing waterless printing master capable of being imaged with an ink accepting particulate imaging material comprising:

(a) providing a self-supporting master substrate;

(b) providing a film forming ink releasing block copolymer comprising elastomeric ink releasing siloxane blocks and isothermally crystallizable thermoplastic organic blocks;

(c) coating said substrate with said copolymer;

(d) isothermally crystallizing said organic blocks, whereby the crystallized organic blocks may be softened by heating said copolymer coating and then hardened so as to bond said particulate imaging material thereto; and (e) allowing said copolymer coated substrate to cool to room temperature.

2. The process of claim 1 wherein said copolymer is coated on the master substrate with a cross-linking agent for said siloxane blocks, and the siloxane blocks are cross-linked subsequent to the crystallizing of said organic blocks, but prior to said cooling of the coating.

3. The process of claim 1 wherein said copolymer is coated on the master substrate with a cross-linking agent for said siloxane blocks, and the siloxane blocks are cross-linked after said coating but prior to crystallizing said organic blocks.

4. The process of claim 1 wherein the crystalline organic blocks of the copolymer have a molecular weight of between about 2000 and 14,000.

5. The process of claim 2 wherein the crystalline organic blocks of the copolymer have a molecular weight of between about 2000 and 14,000.

6. The process of claim 1 wherein the siloxane blocks constitute from 50 to 99 percnt by weight of the copolymer.

7. The process of claim 2 wherein the siloxane blocks constitute from between 50 to 99 percent by weight of the copolymer.

8. The process of claim 1 wherein the siloxane blocks constitute from 80 to 90 percent and the organic crystalline blocks from between 10 to 20 percent by weight of the copolymer.

9. The process of claim 2 wherein the siloxane blocks constitute from 80 to 90 percent and the organic crystalline blocks from between 10 to 20 percent by weight of the copolymer.

10. The process of claim 1 wherein the copolymer comprises poly(hexamethylene sebacate) and poly(dimethylsiloxane) blocks.

11. The process of claim 2 wherein the copolymer comprises poly(hexamethylene sebacate) and poly(dimethylsiloxane) blocks.

12. The process of claim 4 wherein the copolymer comprises poly(hexamethylene sebacate) and poly(dimethylsiloxane) blocks.

13. The process of claim 5 wherein the copolymer comprises poly(hexamethylene sebacate) and poly(dimethylsiloxane) blocks.

14. The process of claim 8 wherein the copolymer comprises poly(hexamethylene sebacate) and poly(-dimethylsiloxane) blocks.

15. The process of claim 9 wherein the copolymer comprises poly(hexamethylene sebacate) and poly(-dimethylsiloxane) blocks.

16. The process of claim 2 wherein after crystallizing the organic blocks but prior to cross-linking the siloxane blocks, an ink accepting particulate imaging material is deposited in image configuration on the copolymer coating of said printing master, and said copolymer coating is heated to soften the organic blocks and thereafter cooled to harden the softened organic blocks so as to bond the particulate imaging material thereto.

17. The process of claim 16 wherein the particulate imaging material deposited is a thermoplastic polymer.

18. The process of claim 16 wherein the particulate imaging material deposited is a crystalline polymer.

19. The process of claim 16 wherein the imaging material comprises poly(α-methylstyrene).

20. The process of claim 16 wherein the siloxane blocks are additionally slightly crosslinked after said coating but prior to said crystallizing.

* * * * *